United States Patent [19]

Burch

[11] Patent Number: 4,830,440

[45] Date of Patent: May 16, 1989

[54] TOOL-FREE CABINET ATTACHMENT

[75] Inventor: A. Robert Burch, Hudsonville, Mich.

[73] Assignee: Haworth, Inc., Holland, Mich.

[21] Appl. No.: 62,809

[22] Filed: Jun. 15, 1987

[51] Int. Cl.[4] ..... A47B 5/00

[52] U.S. Cl. ..... 312/245; 108/152; 312/195

[58] Field of Search ..... 312/194, 195, 196, 197, 312/245; 248/223.1, 188.5; 108/152

[56] References Cited

U.S. PATENT DOCUMENTS

| | | | |
|---|---|---|---|
| 2,455,991 | 12/1948 | Goldfield et al. | 312/195 |
| 2,621,357 | 12/1952 | Stuman | 248/223.1 X |
| 3,697,034 | 10/1972 | Shell | 248/243 |
| 3,862,789 | 1/1975 | Korell et al. | 312/194 |
| 3,942,669 | 3/1976 | Savage, Jr. | 312/245 X |
| 3,947,140 | 3/1976 | Thomas | 248/188.5 X |
| 4,317,416 | 3/1982 | Baum et al. | 248/223.1 X |
| 4,332,205 | 1/1982 | Corl, Jr. | 312/245 X |
| 4,470,716 | 9/1984 | Welch | 248/223.1 X |
| 4,633,789 | 1/1987 | Kortering et al. | 312/195 X |
| 4,660,905 | 4/1987 | Conner et al. | 312/195 |

FOREIGN PATENT DOCUMENTS

| | | | |
|---|---|---|---|
| 137589 | 1/1920 | United Kingdom | 24/669 |

*Primary Examiner*—Peter A. Aschenbrenner
*Assistant Examiner*—Thomas A. Rendos
*Attorney, Agent, or Firm*—Flynn, Thiel, Boutell & Tanis

[57] ABSTRACT

An arrangement for mounting a removable accessory such as a drawer unit to the underside of a work surface without the use of tools. A pair of front and rear slot and projection couplings are used to mount the accessory on the underside of the work surface, and a manually-releasable spring-urged latch device automatically locks the accessory to the work surface when the projections are fully engaged with the slots.

6 Claims, 4 Drawing Sheets

TOOL-FREE CABINET ATTACHMENT

FIELD OF THE INVENTION

This invention relates to an improved arrangement for mounting a component such as a drawer unit to the underside of a work surface, and particularly to a snap lock connection which allows the drawer unit to be mounted or demounted without the use of tools.

BACKGROUND OF THE INVENTION

U.S. Pat. No. 4,633,789, as owned by the assignee of this invention, discloses an arrangement for permitting mounting of a drawer unit or similar component to the underside of a work surface or table, which mounting arrangement enables a snap lock connection to be achieved without requiring the use of tools. While the arrangement disclosed in the aforementioned patent has proven highly desirable, particularly in view of its ability to permit a component to be easily and effectively mounted under a work surface by means of a snap lock connection, nevertheless the present invention relates to additional improvements which have been incorporated into the snap lock connection so as to further facilitate both the mounting and demounting of the component without requiring tools and without requiring undue effort on the part of the installer.

In the present invention, the mounting arrangement includes a work surface and a removable component or accessory mounted on the underside thereof. The mounting arrangement includes a pair of front and rear slot-and-projection couplings for fixedly mounting the accessory unit to the underside of the work surface. An elongate cantilevered spring is associated with the component and has an enlarged finger-engaging projection associated with the free end thereof, which projection is automatically urged into one of the slots formed in the work surface when the component is properly mounted and positioned thereon. This enables the component to be easily mounted on the work surface and securely held in the locked position. The finger-engaging projection, however, can be readily manually gripped so as to move it out of the slot, whereupon the component can be readily demounted from the work surface without requiring tools or the like.

Other objects and purposes of the invention will be apparent upon examination of the accompanying drawings and study of the following specification.

Figure 1:
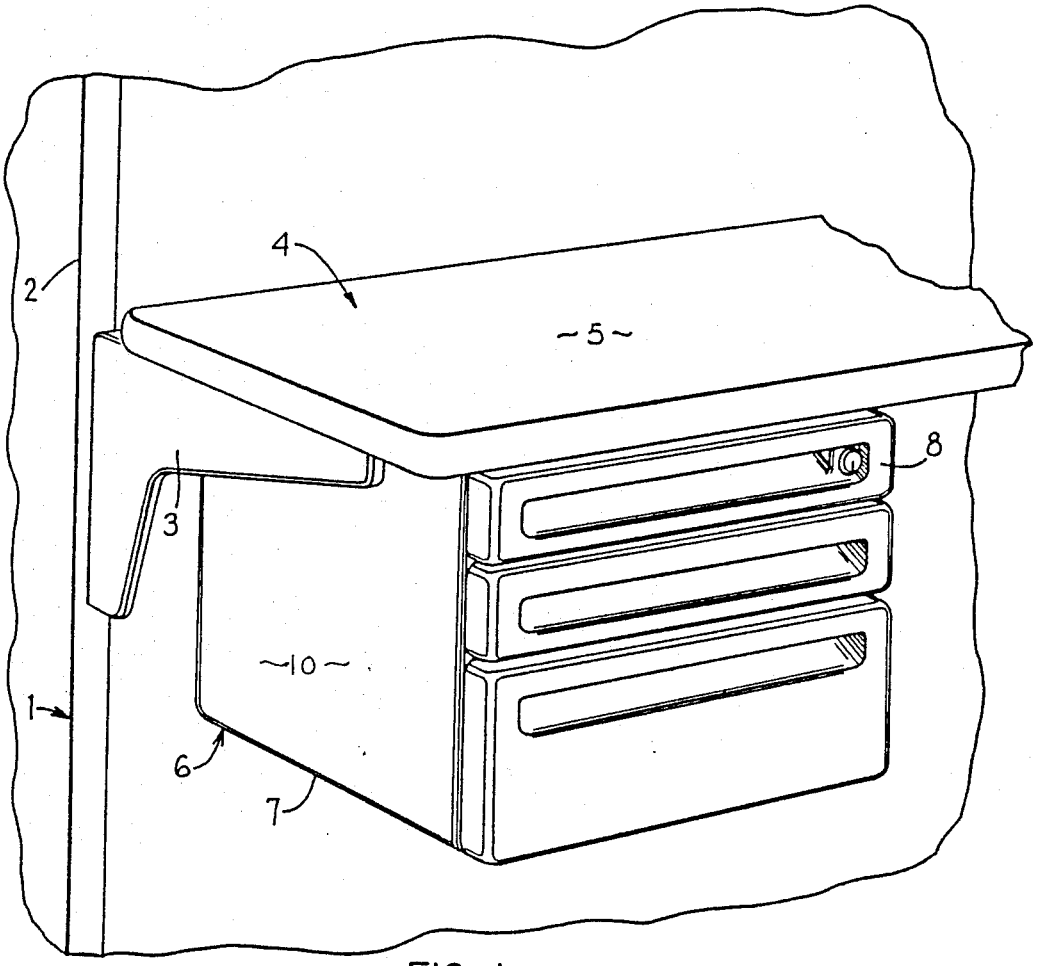
FIG. 1 is a perspective view of a typical arrangement showing a drawer unit suspended from the underside of a work surface.

Certain terminology will be used in the following description for convenience in reference only, and will not be limiting. For example, the words "upwardly", "downwardly", "rightwardly" and "leftwardly" will refer to directions in the drawings to which reference is made. The word "front" will refer to the end from which the drawers are opened, namely the leftward side in FIGS. 2 and 3. The words "inwardly" and "outwardly" will refer to directions toward and away from, respectively, the geometric center of the apparatus and designated parts thereof. Said words will include the word specifically mentioned, derivatives thereof, and words of similar import.

DETAILED DESCRIPTION

Referring to the drawings, FIG. 1 shows a conventional arrangement 1 wherein an upright wall panel 2 has a plurality of cantilevered support arms 3 mounted thereon for supporting a work surface member or table top 4 having a substantially planar upper work surface 5. An accessory or component 6, such as a drawer unit or filing cabinet, is mounted to the underside of the work surface 4. The drawer unit 6 includes a housing 7 which supports a plurality of drawers 8 which can be opened from the front of the unit. The drawers 8 are mounted for reciprocal movement by means of conventional slide assemblies 9 (FIG. 2) connected between the drawers 8 and sidewalls 10 of the housing 7.

Figure 2:
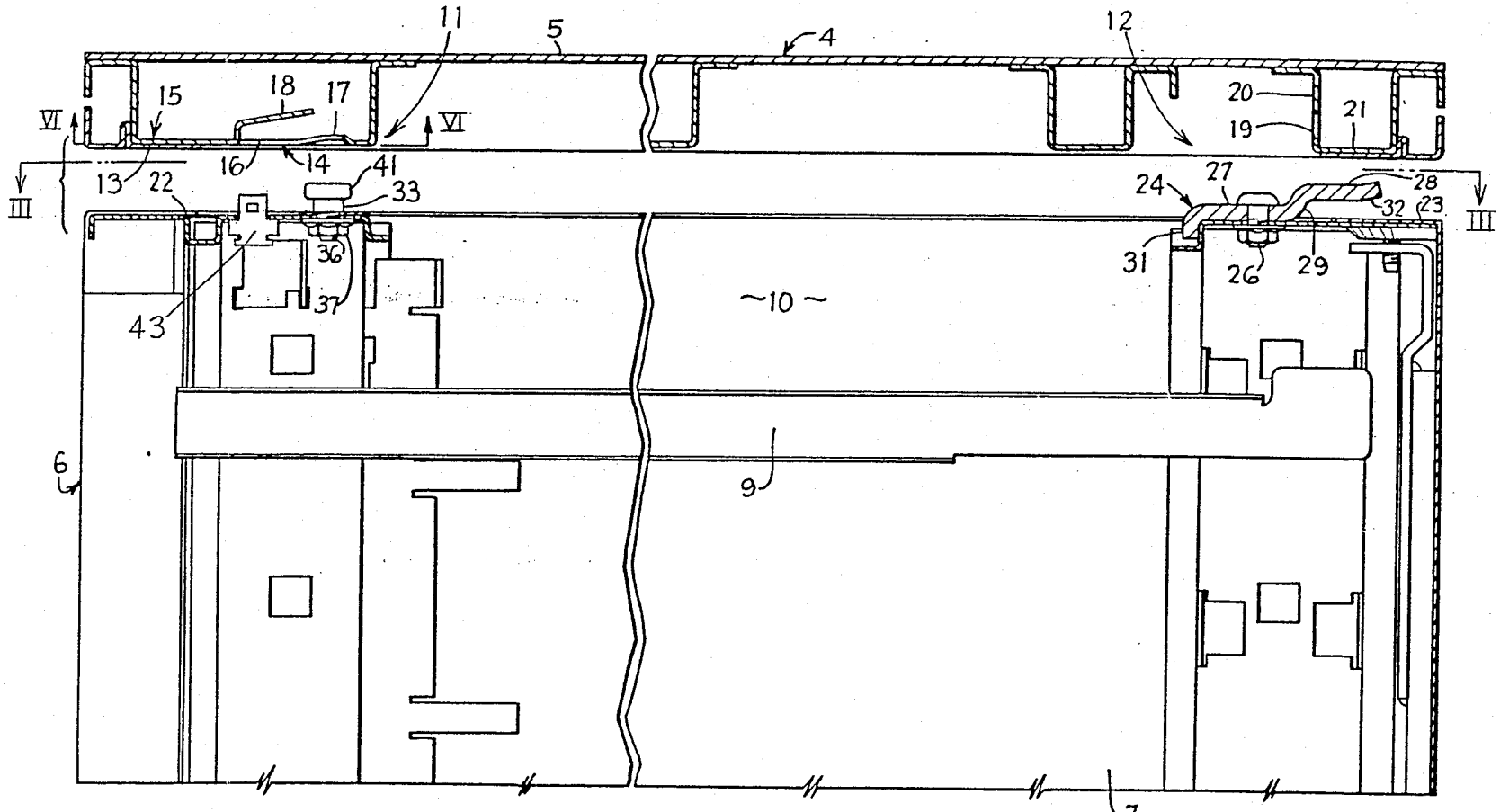
FIG. 2 is a partial cross-sectional view of the mounting arrangement according to the invention, showing the component detached from the underside of the work surface.

FIG. 2 illustrates the moving arrangement according to the present invention for mounting the drawer unit 6 in suspended relation below the work surface member 4. This mounting arrangement includes a pair of front projection-and-slot means 11 adjacent the upper front corners of the drawer unit 6, and a pair of rear projection-and-slot means 12 adjacent the upper rear corners of the drawer unit 6.

Figure 6:
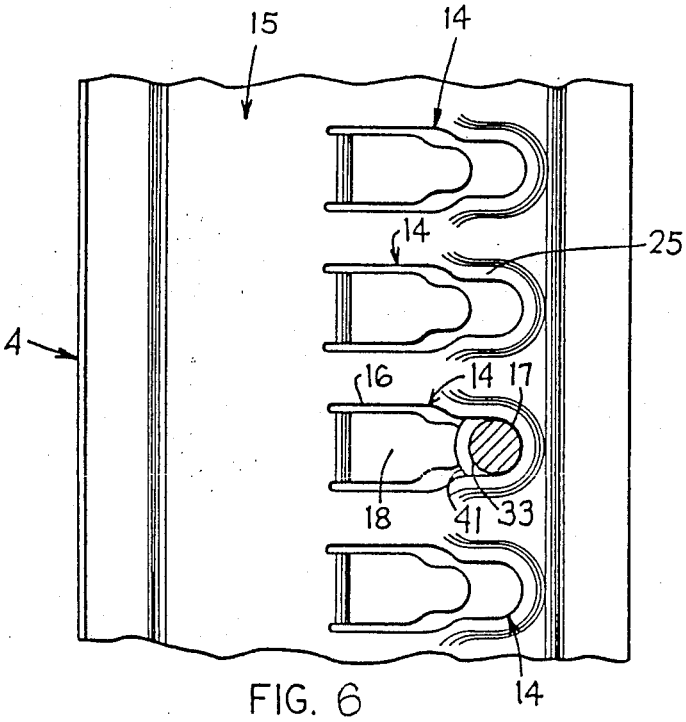
FIG. 6 is a view taken along line VI—VI in FIG. 2.

Each projection-and-slot means 11 includes a keyhole-shaped slot 14 which opens downwardly from the bottom wall or underside 13 of and adjacent the front edge of the work surface member 4. This slot 14 is elongated in the front-to-back direction of the drawer unit 6 and work surface member 4. As shown in FIG. 6, a plurality of front keyhole slots 14 are preferably formed in a row along the bottom wall 13 in parallel relation to the adjacent front edge of the work surface member 4. Each front slot 14 has a front slot portion 16 and a rear slot portion 17. The front slot portion 16 is of greater width than the rear slot portion 17.

The bottom wall 13 is part of a metal channel member 15 which comprises part of the work surface member 4 and extends lengthwise thereof. The slots 14 are stampedout of the wall 13, and a part of the wall 13 is deformed upwardly to form a ramp-like cam 25 (FIG. 6) in surrounding relation to the rear slot portion 17 so that the depth of the slot 14 tapers (i.e., decreases) from the end of the rear slot portion 17 forwardly as shown in FIG. 2. The front keyhole slot 14 is substantially horizontal, and a keyhole cover 18 integral with the wall 13 and formed during the stamping operation used to form the slot 14 covers each of the front slots 14. The keyhole cover 18 is spaced slightly upwardly from the bottom wall 13.

The projection-and-slot means 11 also includes a front projection or mounting pin 33 which is an upright projection having an annular flange 41 at the upper end thereof. The mounting pin 33 is fixedly secured into one of a plurality of holes 34 in a front top wall 22 of the drawer unit 6. The front top wall 22 extends across the width of the unit 6 and spans the sidewalls 10. The mounting pin 33 has a threaded lower end 36 which extends through the hole 34, and a nut 37 threadedly coupled to the threaded end 36 secures the pin 33 to the front top wall 22.

The rear projection-and-slot means 12, located at the rear left and right corners of the upper side of the unit 6, includes a plurality of rear, frontwardly opening slots 19 formed in a front wall 20 of a channel member 21 which is part of the work surface member 4 and extends lengthwise thereof in parallel with the channel member 15. A projection member 24 which is substantially Z-shaped in cross section is secured by a nut and bolt fastener 26 extending throughone of a plurality of rear mounting holes 30 to a rear top wall 23 of the drawer unit 6. The rear top wall 23 extends across the width of the drawer unit 6 and spans the sidewalls 10, in parallel with the front top wall 22.

The rear projection 24 comprises upper and lower horizontal portions 28 and 27 integral with and connected by a substantially vertically extending portion 29 which gives the rear projection 24 its cross-sectional Z shape. The lower horizontal portion 27 has an opening therethrough for the fastener 26, and has a downwardly turned end 31 which extends over a front edge of the top wall 23. The upper horizontal portion 28 of the rear projection 24 extends rearwardly and has a slightly upwardly bent end 32.

The mounting arrangement is assembled as follows. First, the slightly upwardly bent ends 32 of the rear projections 24 are slightly inserted into selected rear slots 19 to provide at least partial support for the rear end of the unit 6. The front end of unit 6 is then lifted upwardly so that the front mounting pins 33 are inserted through the front portion 16 of the front keyhole slots 14. The flange 41 at the uppermost end of the mounting pin 33 has a diameter slightly less than the width of the front slot portion 16, but greater than the width of the rear slot portion 17. Once the flanges 41 have been inserted upwardly completely through the front slot portions 16, the drawer unit 6 is then pushed rearwardly relative to the work surface member 4. This causes the upper horizontal portions 28 of the rear projections 24 to be slidably inserted more fully into the rear slots 19, and simultaneously causes the pins 33 to travel rearwardly along the length of the front slots 14 until they enter the slot end portions 17. Since the flange 41 is of greater diameter than the slot end portion 17, the front end of the drawer unit 6 is thereby suspended from the front end of the work surface member 4. In addition, the flange 41 travels upwardly along the tapered portion of the slot 14 along the cam part 25 to lift the top wall 22 substantially flush with the channel bottom wall 13. This also causes the front pins 33 to be snugly frictionally held in place. The drawer unit 6 is thus securely fitted to the underside of the work surface member 4.

The structure of the mounting arrangement as described above corresponds to the aforementioned U.S. Pat. No. 4,633,789.

To securely maintain the drawer unit 6 attached to the work surface 4 while also permitting simple release therebetween the mounting arrangement includes a spring-type latch 41 associated with each of the projection-and-slot means 11. The latch 41 provides a positive holding or locking structure which prevents the projection-and-slot means 11 from being disengaged except by a deliberate manual release of the latch.

Figure 3:
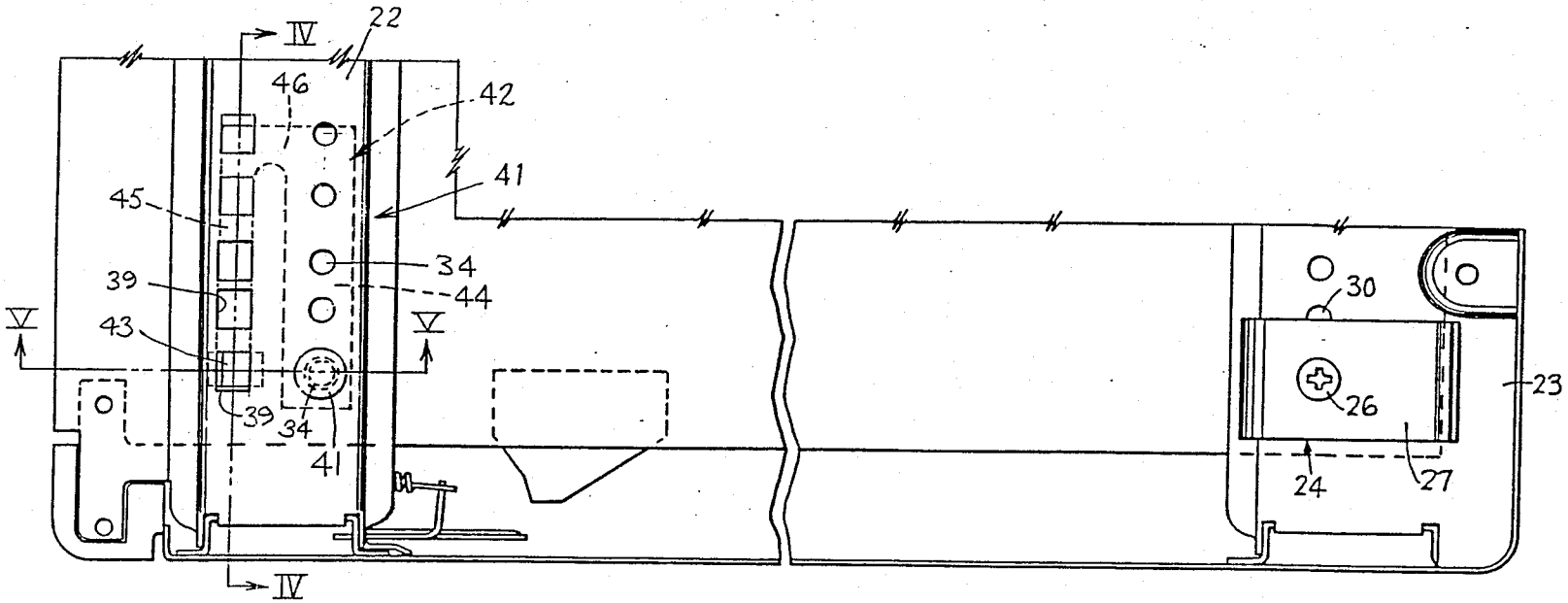
FIG. 3 is a partial top view of a right side portion of the component shown substantially along the line III—III in FIG. 2.
Figure 4:
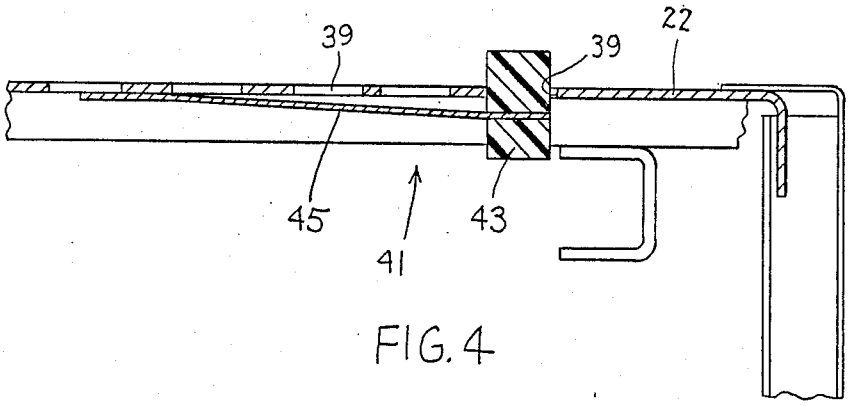
FIG. 4 is a fragmentary sectional view taken along line IV—IV in FIG. 3.
Figure 5:
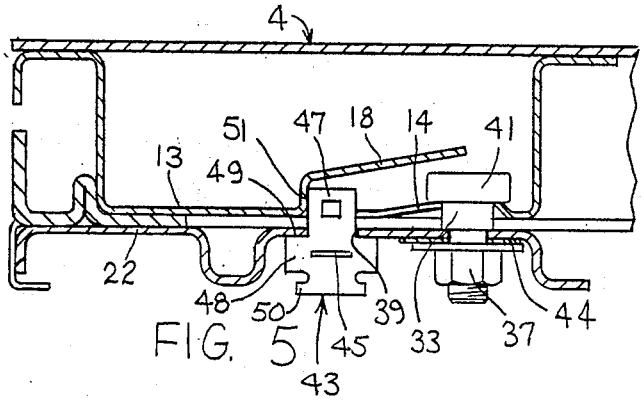
FIG. 5 is a fragmentary sectional view taken substantially along line V—V in FIG. 3 and showing the projection engaged with the slot formed in the underside of the work surface.

The spring-type latch 41, as illustrated by FIGS. 3–5, includes a substantially U-shaped spring plate 42 (shown by dotted lines in FIG. 3) having a latching projection 43 associated therewith, which projection 43 is adapted to project up through one of a series of holes 39 formed in the front top wall 22 of the drawer unit, substantially as illustrated by FIG. 4.

The U-shaped spring plate 42 is mounted directly beneath the top wall 22 of the drawer unit in the vicinity of the front edge thereof, and includes elongate and generally parallel side legs 44 and 45 which are joined together by a bight 46. The side leg 44, in the vicinity of the free end thereof, is clampingly secured to the top wall 22, this being accomplished by means of the free end of the side leg 44 being clampingly held between the top wall 22 and the nut 37 (FIG. 5) associated with the front projection 33. On the other hand, the latching projection 43 is fixedly secured to the other side leg 45 adjacent the free end thereof. The latching plate 42 otherwise is free of rigid connection to the top plate 22, and hence functions as an elongated plate-like cantilevered leaf spring extending outwardly from its anchor point at the pin 33. The cantilevered spring plate 42 is of significant length to provide significant flexing at the free end thereof where the latching projection 43 is located. The overall spacial requirements for the latching plate are significantly reduced by its U-shaped configuration.

The latching projection 43 is provided with a blocklike configuration and includes an upper blocklike portion 47 having a cross section suitable to enable it to project upwardly through the opening 39 into the wide front slot portion 16 associated with the work surface member 4. The latching projection 43 engages the same slot 14 as the adjacent pin 33.

The blockline latching projection 43 also has a lower blocklike portion 48 which is of larger cross section than the upper blocklike portion 47, whereupon there is thus defined upwardly facing shoulders 49 at the interface between the upper and lower portions. This lower block-like portion 48 has a width which is greater than that of the opening 39, and the shoulders 49 act as stops to abut the underside of the top plate 22 and hence limit the upward extension of the latching projection 43. This lower portion 48 also has a finger-engaging part 50 associated with the lower end thereof, the latter preferably being formed by a pair of flanges which project sidewardly in opposite directions so as to facilitate manual gripping of the latching projection 43. The latching projection is preferably formed of a relatively hard plastics material since this will permit it to perform the desired latching function, and at the same time it is relatively noiseless and has the ability to absorb impacts.

The latching spring plate 42 is preferably formed from a thin metallic plate, as by a stamping operation, so as to possess significant elasticity whereby the projection 43 is continuously resiliently upwardly toward a position of latching engagement.

After the drawer unit 6 has been attached to the underside of the work surface member 4, as described above, and particularly when the drawerunit is slid rearwardly so that the mounting pins 33 are disposed in the rear portions 17 of the slots 14, then this results in the openings 39 in the top plate 22 being aligned under the front slot portions 16. Thus, the cantilevered plate spring 42 automatically urges the projection 43 upwardly so that the upper blocklike portion 47 enters into the front slot portion 16 substantially as illustrated by FIG. 5. When in this latching position, the upper block-like portion 47 is disposed directly rearwardly of the base part 51 of the tab 18, which base part projects transversely from the bottom wall 13 and acts as the stop so as to prevent the drawer unit 6 from being moved forwardly relative to the work surface. This positively maintains the drawer unit in a securely locked position in suspended relationship on and below the work surface.

When removal of the drawer unit from the work surface is desired, it is first necessary to manually remove or disengage the latching projection 43. This can be easily accomplished by manually gripping the finger flanges 50 associated with the projection 43, following which the projection 43 can be readily manually pulled downwardly against the urgin of the spring plate 42 so that the upper projection portion 47 disengages the slot 14. While maintaining the projecting 43 in this lowered release position, then the complete drawer unit 6 can be slid forwardly a small amount relative to the work surface, which results in the projection 43 no longer be aligned under the slot 14 and hence reengagement of the spring latch is prevented. The drawer unit 6 can thus be totally removed from the work surface, and such can be accomplished in a simple manner using wholly manual manipulations, and without requiring the use of any special tools.

In the spring-type latch of the present invention, all front-to-rear impact loads transmitted between the work surface member 4 and the drawer unit 6, such as due to continual opening and closing of the drawer associated with the drawer unit, are readily absorbed by the latching projection 43, and are not transmitted to the latching spring. This eliminates any potential collapse or fatigue failure of the spring since the spring is relatively free of loading when the drawer unit is latched to the work surface member. Further, the latching device is also mounted in its entirety below the top wall 22 of the drawer unit and hence is readily visible and accessible to service personnel, such as for adjustment purposes.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In combination, a work surface, an accessory removably mounted on the underside of the work surface, and a mounting arrangement mounted on and coacting between the work surface and accessory for permitting the accessory to be mounted on and removed from the work surface without the aid of tools, said mounting arrangement comprising:

front slot-and-projection coupling means for releasably mounting the front end of said accessory on the underside of said work surface, said front coupling means permitting assembly of said accessory and work surface by first requiring said accessory to be relatively moved substantially perpendicularly toward the underside of said work surface followed by slidable displacement of the accessory relative to the work surface substantially horizontally rearwardly of the latter;

rear slot-and-projection coupling means for releasably mounting a rearward end of said accessory on the underside of said work surface;

said front coupling means including a substantially horizontal, downwardly opening, elongated front slot formed on the underside of said work surface, said front slot having a mouth of enlarged width adjacent the front end thereof and being of reduced width as the slot projects rearwardly of the work surface;

said front coupling means including a front upright projection on top wall means of said accessory, said front projection having flange means adjacent the upper end thereof, said front projection being moved upwardly with respect to the work surface so that the flange means is inserted through the mouth of the slot adjacent the front end thereof, with said accessory and the front projection then being moved rearwardly relative to the work surface so that the projection moves along the narrow portion of the front slot so that the flange means is captivated thereabove;

self-locking releasable spring-type latch means coacting between said accessory and said work surface for automatically locking said front projection adjacent the rearward end of said front slot to prevent accidental disengagement of said accessory from said work surface;

said latch means including an elongated cantilevered spring plate positioned below the top wall means of said accessory and being elongated in a direction which extends sidewardly relative to said accessory, said cantilevered spring plate being of a U-shaped configuration and including a pair of elongate side legs joined together by a bight, said side legs extending in the sideward direction of said accessory, one of said side legs being anchored to said top wall means adjacent the free end thereof, the other side leg having an upwardly-extending latch projection mounted thereon adjacent the free end thereof, said top wall means having opening means therein through which said latch projection projects upwardly, said spring plate normally resiliently urging and maintaining said latch projection so that it projects upwardly through said opening means beyond said top wall means, said opening means in said top wall means being substantially vertically aligned below the front portion of said front slot only when the front projection is disposed in the rear portion of said front slot so that the latch projection is automatically spring-urged into the front portion of said slot, and said work surface defining on the underside thereof a stop adjacent the front end of said front slot for preventing forward movement of the latch projection relative to the work surface when the latch projection is engaged within the front portion of said front slot, said spring plate otherwise being free of securement to said top wall means so that both of said side legs can be resiliently deflected downwardly to permit the latch projection to be manually displaced downwardly to withdraw it from the front slot.

2. A combination according to claim 1, wherein said one leg of said spring plate has the free end thereof anchored to said top wall means at the location of said front projection, and wherein said latch projection is disposed closely adjacent by spaced slightly forwardly from said front projection.

3. A combination according to claim 2, wherein said rear coupling means includes a rear slot formed in the work surface on the underside thereof in rearwardly spaced relationship from said front slot, and a rear projection which is fixed to said accessory adjacent the rearward end thereof for engagement with said rear slot.

4. In a mounting arrangement including a work surface and a removable accessory mounted on the underside of said work surface, the combination comprising:

said work surface having a substantially horizontal, downwardly opening, elongated front slot formed on the underside thereof, said front slot being wider at its front end and narrower at its rear end;

said accessory having a front upright projection on top wall means thereof, said front projection having flange means formed adjacent the tip thereof, said front projection being insertable through a forward end portion of said front slot on the underside of said work surface and then movable rearwardly along said front slot to the narrower rear end thereof so that the front projection is vertically secured to the underside of the work surface;

said accessory further having self-locking releasable spring-type latch means for positively holding said front projection adjacent the rearward end of the front slot when the accessory is mounted to the underside of the work surface;

said latch means comprising an elongate cantilevered spring plate which is positioned adjacent said top wall means and has one end thereof fixedly anchored relative to said top wall means, said spring plate adjacent the other free end thereof having a blocklike latching projection fixed thereto and projecting upwardly relative to the spring plate, said top wall means having opening means extending vertically thereof, said latching projection being positioned in alignment with said opening means so as to normally project vertically upwardly therethrough due to the upward urging of said spring plate, said opening means being aligned with an opening in the underside of said work surface only when the accessory is disposed with the front projection at the rearward end of said front slot so that said latching projection is spring urged upwardly into the opening in the underside of the work surface to prevent the accessory from being moved forwardly relative to the work surface;

said blocklike latching projection including a gripping portion which projects downwardly from said spring plate to facilitate manual gripping thereof when downward manual release of the latching projection is desired; and said cantilevered spring plate comprising a generally horizontally flat plate of U-shaped configuration having a pair of sidewardly-adjacent and resiliently-deflectable side legs which have one pair of adjacent ends joined together by a bight, one said side leg having the latching projection fixedly secured thereto adjacent the free end thereof, the other said side leg being fixedly anchored to said top wall means adjacent the free end thereof, said spring plate being otherwise free of connection to said top wall means so that vertical displacement of the latching projection relative to top wall means causes resilient cantilevered deflection of each said side leg.

5. A combination according to claim 4, wherein said cantilevered spring plate is elongated in the sideward direction of the accessory.

6. A combination according to claim 4, including releasable rear coupling means coacting between said accessory and said work surface for permitting the rearward end of said accessory to be releasably coupled to the underside of said work surface, said rear coupling means being disengageable only when the accessory is moved forwardly relative to the work surface so that the front projection is disengaged from the rearward end of said front slot.

* * * * *

UNITED STATES PATENT AND TRADEMARK OFFICE

CERTIFICATE OF CORRECTION

PATENT NO. : 4 830 440

DATED : May 16, 1989

INVENTOR(S) : A. Robert Burch

It is certified that error appears in the above-identified patent and that said Letters Patent is hereby corrected as shown below:

Column 7, line 1; change "by" to ---but---.

Column 8, line 26; after "to" insert ---the---.

Signed and Sealed this

Twentieth Day of February, 1990

*Attest:*

JEFFREY M. SAMUELS

*Attesting Officer*

*Acting Commissioner of Patents and Trademarks*